US005677672A

United States Patent [19]

Vogt et al.

[11] Patent Number: 5,677,672

[45] Date of Patent: Oct. 14, 1997

[54] SYSTEM AND METHOD FOR ARMING AN ALARM SYSTEM WHEN AN OCCUPANT FAILS TO TURN THE SYSTEM ON

[75] Inventors: William R. Vogt, Rockaway, N.J.; John E. Seeley, Jamison, Pa.; Leonard Noonan, Andover, N.J.

[73] Assignee: Wells Fargo Alarm Services, Inc., Parsippany, N.J.

[21] Appl. No.: 491,611

[22] Filed: Jun. 16, 1995

[51] Int. Cl.[6] ..... G08B 29/00

[52] U.S. Cl. ..... 340/506; 340/527; 340/528

[58] Field of Search ..... 340/506, 527, 340/528, 309.15, 514, 515, 526

[56] References Cited

U.S. PATENT DOCUMENTS 4,157,540 6/1979 Oros ..... 340/539

4,543,568 9/1985 Hwang ..... 340/309.15

4,879,542 11/1989 Elsey ..... 340/309.15

5,057,816 10/1991 Kostusiak et al. ..... 340/527

*Primary Examiner*—Donnie L. Crosland

*Attorney, Agent, or Firm*—Laff, Whitesel, Conte & Saret, Ltd.

[57] ABSTRACT

An alarm system including a sensor for providing an output signal upon sensing a given condition, an alarm unit for providing an alarm signal on receipt of the output signal, and a timer, coupled between the sensor and the alarm unit, which is reset to a preset count each time it receives an indication that the sensor has detected the given condition where the timer is allowed to count down from a preset count while no sensor is providing output signals and an arming signal is generated by the timer when it completes the countdown.

10 Claims, 2 Drawing Sheets

SYSTEM AND METHOD FOR ARMING AN ALARM SYSTEM WHEN AN OCCUPANT FAILS TO TURN THE SYSTEM ON

BACKGROUND OF THE INVENTION

The present invention is directed to an alarm system of the type which is turned on when the occupant leaves the premises, and more particularly to such a system which automatically turns the system on when the occupant forgets to do so.

Some alarm systems are set by timers to turn on automatically when the premises are empty at night, and then turn off in the morning when the business re-opens. Other systems have more irregular hours, and the occupant arms (turns on ) the system when he leaves at the close of business, and the first to arrive in the morning turns the system off. Unfortunately the person often fails to turn the system on when he leaves at night. For example, two businesses may occupy individual offices on either side of a foyer or common area. When the occupant of business A arrives and goes through common area C, he then turns off the system for areas A and C. The occupant of area B arrives and goes through foyer C to his own office, and turns off the system for area B. Suppose B goes home first; he arms the system for B, but does not know wether A is still in his area, and so does not arm common area C. Later A goes home, and forgets to arm the system for areas A and C. This means the system will not afford protection for these areas if there is a break-in during the night. The present invention overcomes this human failure by automatically arming the system after the expiration of a preset time period and the occurrence of a logical function, such as no movement in the defined area during the preset time.

Another field where the invention is particularly helpful is in the area of protecting automatic teller machines (ATM's) which automatically dispense cash and provide other banking functions without the intervention of a human teller. When such a machine is serviced to replenish the cash, remove credit/debit records, and so forth, the service man is careful to disarm the alarm system before unlocking the ATM. After the servicing the service person is careful to re-lock the ATM, but sometimes forgets to re-arm the system. The present invention not only automatically arms the system when the service person fails to do so, but has another feature which provides a warning to the service person before the system is re-armed. This allows a person who is studying a manual, or servicing a part without moving his body, to make a motion or take other action to avoid being trapped by the re-armed system before his work is finished.

SUMMARY OF THE INVENTION

The present invention is directed to a system, such as a security system, for protecting against a certain condition, such as unauthorized entry, or other conditions or activities. A sensor means is provided to produce an output signal when such activity or condition is sensed. If the sensor is a motion detector (such as a passive infrared detector), then an output signal is produced when motion is detected in the coverage area of the sensor. An alarm unit is provided which delivers an alarm signal (visual, audible, electronic, or other) when (1) the alarm unit is armed, and (2) the alarm unit receives an output signal from the sensor means. A timer means is coupled to the sensor means and the alarm unit. The timer is of the type which determines a preselected time period, for example, 20 minutes, and then provides an arming signal to the alarm unit to arm (turn on) the alarm unit at the expiration of said time period. The timer is reset to the original preselected time period, each time it receives an indication the sensor has detected the certain condition for which it is designed. That is, if it is designed to sense motion, if motion is detected in the protected area, the timer is reset to the preselected time period and re-commences the timing sequence.

The system can utilize the sensor(s) output signal to generate alarm conditions while the alarm unit is in the armed state, effectively these sensor(s) provide dual-use. When the system is not armed, they function in the arming process, then when the system is armed, they function in identifying alarm conditions.

The system can utilize the timer to issue a warning signal at a predetermined interval before the issuance of the arming signal to the alarm unit. For example if the preset count is for 20 minutes, then the timer can issue the warning signal one minute prior to issuance of the arming signal. Some warning means, such as a bell, a high-intensity, flashing light (such as a strobe light)or other means is connected for activation by the warning signal. For L-shaped or other unusual areas to protect, a second sensor can be provided and coupled to the timer. This is another path to provide an output signal to the timer when a given condition is detected. The second sensor may differ from the first and provide such output signal when a different condition or activity is detected.

THE DRAWINGS

In the several figures of the drawings, like reference numerals indicate like components, and in those drawings.

DETAILED DESCRIPTION OF THE INVENTION

Figure 1:
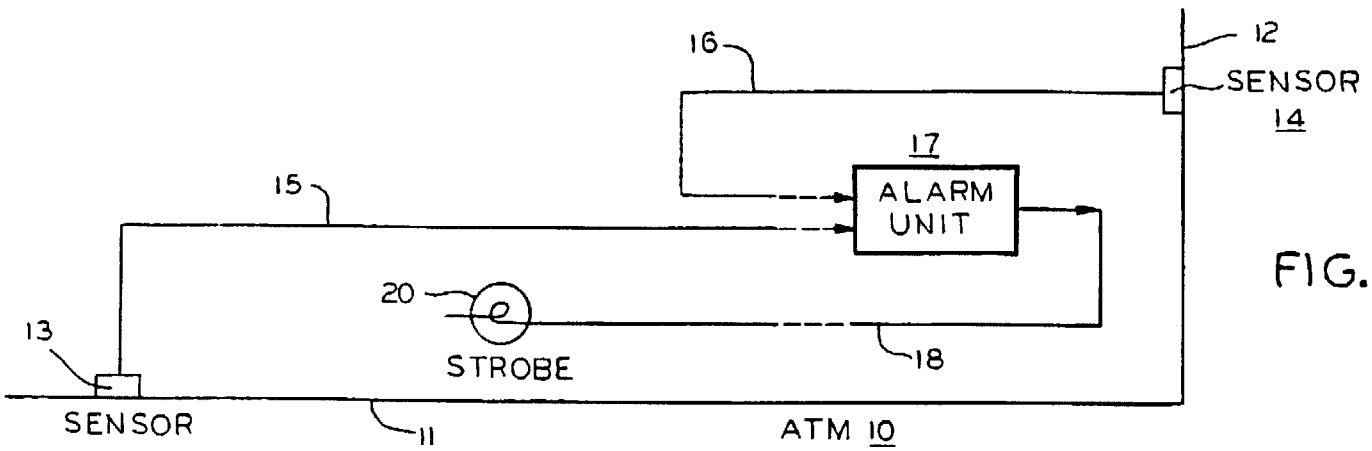
FIG. 1 is a partial layout of an ATM to be protected by the invention.

FIG. 1 shows an Automatic Teller Machine (ATM) 10, of which a portion of walls 11 and 12 are shown. A first sensor means 13 is mounted on wall 11, and a second sensor means 14 is mounted on wall 12. Sensors 13 and 14 are coupled over conductors 15, 16 to an alarm unit 17. Those skilled in the art will understand that each or either of conductors 15, 16 may comprise a plurality of wires, a coaxial cable, a path through the atmosphere, or other means for communicating the output signals from the sensors to the alarm unit. Alarm unit 17 is coupled over conductor 18 to a warning means 20, such as a strobe light, or the audible sounder on the alarm unit itself, either of which may be found within the interior of the ATM.

Figure 2:
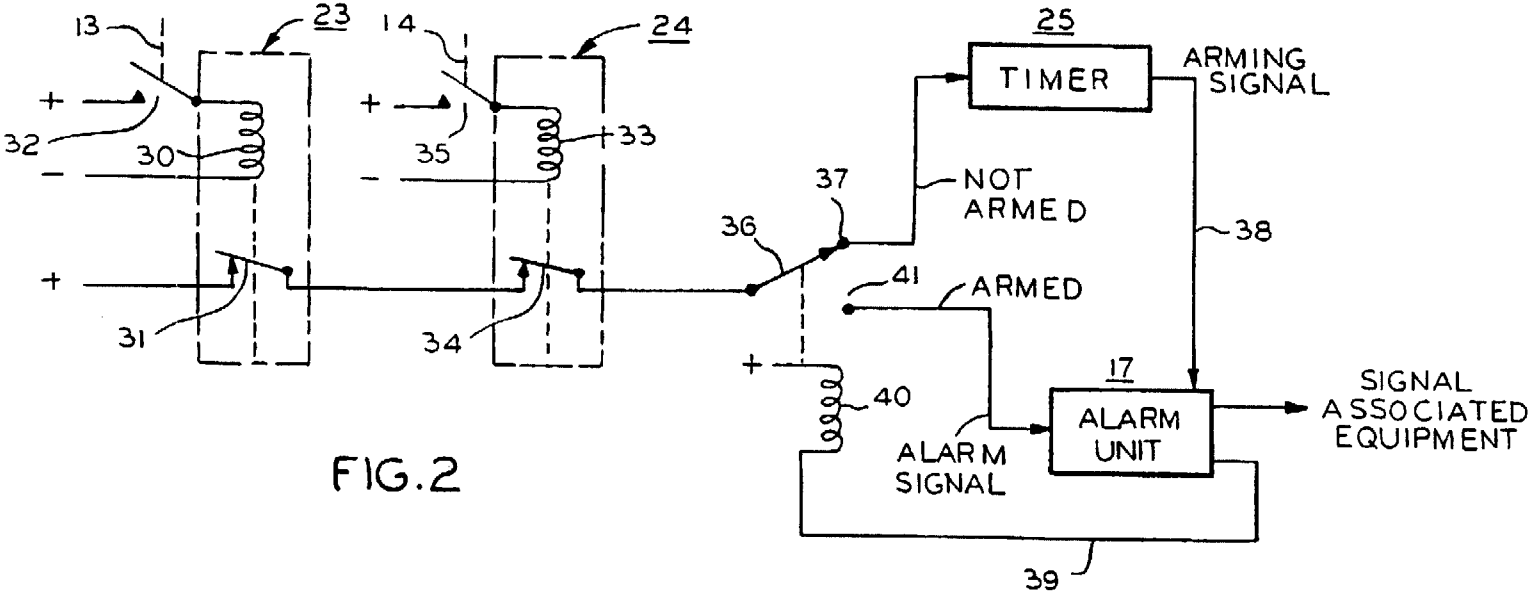
FIG. 2 is a schematic diagram illustrating a preferred embodiment of the invention.

FIG. 2 shows one arrangement for communicating between the sensors 13, 14 and timer means 25, and also with alarm unit 17. It should be noted that the same sensor (or sensors) which provide the reset signals to the timer 25 are also used, after alarm unit 17 is armed, to provide alarm-indication signals to the alarm unit.

As there shown sensor 13 controls operation of a relay assembly 23, which includes a winding 30, and a normally-closed contact set 31. Sensor 14 controls operation of another relay assembly 24, which includes a winding 33, and a normally-closed contact set 34. For purposes of explanation the actuation of relay 23 occurs as detector 13 senses a particular condition and closes a contact set 32. Generally a semiconductor switch is used, rather than a mechanical switch as shown, but this arrangement simplifies the explanation. Likewise sensor 14 can provide an output signal, represented by the closure of contact set 35, to energize relay assembly 24. To illustrate operation, assume a person has opened the back door of ATM 10, disarmed alarm unit 17, and serviced the machine. Then the person diligently locks the back of the machine, but forgets to re-arm alarm unit 17. At this time the contact sets 31 and 34 are in their respective positions as shown in FIG. 2.

With either relay 23 or 24 energized, timer 25 is energized over a circuit including contact set 36, 37 and timer 25 begins to count. In the described embodiment it counts down from a preset count, such as 20 minutes. Absent any actuation of either relay 23 or 24, at the end of 20 minutes, timer 25 provides an arming signal over line 38 to alarm unit 17, and the alarm unit is turned on to protect the ATM.

The timer is reset to the original count (20 minutes in this example) each time an output signal is issued from either of sensors 13 and 14. If sensor 13 detects its particular condition, it operates relay 23, which at its contact set 31 interrupts the energizing circuit for timer 25, which is then reset to the preset count. When the sensed condition (such as motion) stops or changes, the relay is de-energized and contact set 31 re-closes so that timer 25 can again begin to count down. Sensor 14 and relay 24 operate in the same manner. Both contact sets 31 and 34 must close, and remain closed for 20 minutes (or any other preset time period) to complete the timing sequence in the timer. When the timing sequence is completed without interruption by opening of either contact set 31 or 34, timer 25 issues the arming signal to the alarm unit 17, and arms this unit.

When alarm unit 17 is armed, it completes an energizing circuit over conductor 39 to relay winding 40, which operates and displaced movable contact 36 to engage fixed contact 41. Thus any output signals from either of sensors 13 and 14 will now be routed over contacts 36,41 and applied to alarm unit 17 as alarm—indicating signals.

In accordance with an important feature of the invention, the timer 25 is set to provide a warning signal over line 40 at a predetermined interval before the alarm unit 17 is armed. As shown this warning signal is applied to a warning means, such as a strobe light, to alert persons in the vicinity that the unit is about to be armed. This gives the service man an opportunity to re-start the timer.

An important feature of this invention is that the same sensor (or sensors) which regulate the timer during the counting interval later, after the alarm unit is armed, send the alarm indications directly to the alarm unit. Specifically if sensor 14 is a motion detector and, after the alarm unit is armed (turned on) it detects, motion in its vicinity, it causes operation of relay 24 as explained above. Relay 24 operates and contact set 34 is opened. This information is passed over contacts 36 and 41 directly to alarm unit 17. Thus the sensor does double duty. First it regulates operation of the timer until the alarm unit is turned on, or armed, and thereafter it provides alarm signals directly to the alarm unit to enable that unit to take the appropriate action.

Figure 3:
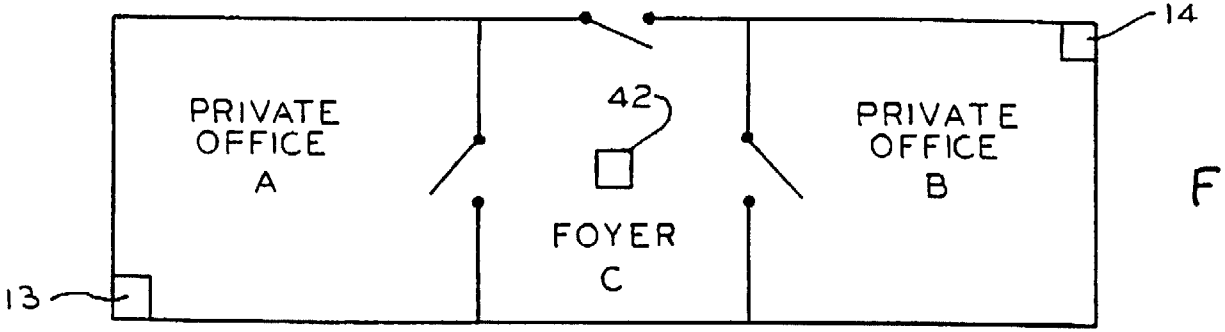
FIG. 3 is a simplified layout depicting another physical arrangement which lends itself to protection by the present invention.

FIG. 3 shows a pair of private offices A and B which are accessed through a common area or foyer C. Sensor 13 is positioned to monitor some condition or activity in area A, and sensor 14 is positioned to monitor some condition in office area B. A sensor 42 is positioned in the common area C to detect some condition, such as movement, in area C. All these sensors 13, 14 and 42 will be assumed to provide an output signal when movement is seen in the vicinity of a sensor, but of course each sensor could also provide other information, such as heat rise, status of another group of alarms or detectors, or any desired data. The operation of sensors 13, 14 and their associated components have been explained in connection with FIG. 2. In a similar manner, as shown in FIG. 4, sensor 42 will be presumed to close a switch 43 when sensor 42 detects a given condition adjacent the sensor.

Figure 4:
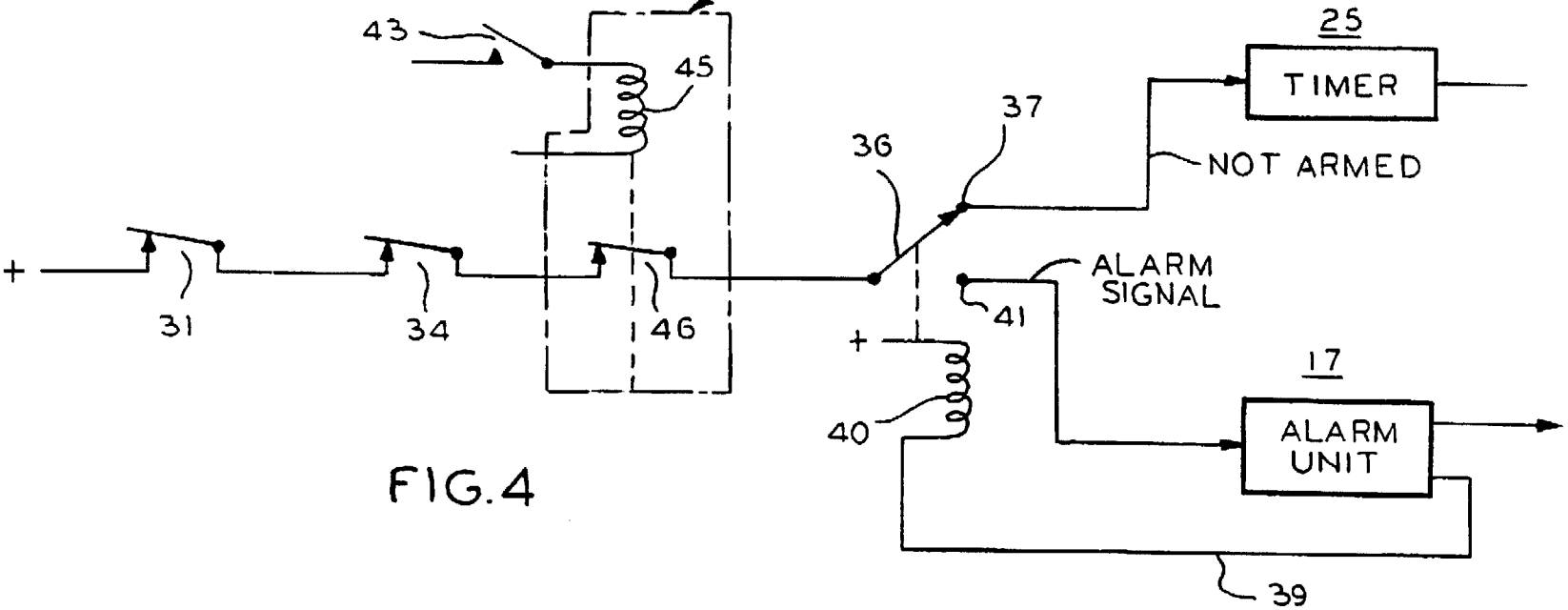
FIG. 4 is a partial schematic diagram useful in understanding the embodiment of the invention shown in FIG. 3.

As shown in FIG. 4, closure of switch 43 actuates a relay assembly 44, which includes a relay winding 45, and a normally-closed contact set 46. Contact set 46 is coupled in series between contact set 34 and contact set 36, 37, which in turn are coupled to the input side of timer 25. Accordingly movement of a person adjacent any of the sensors will open one of the series-coupled contact sets 31, 34, and 46 and thereby reset timer 25 to re-commence its counting at the original preset count. After the timer runs through its sequence without being reset by a signal from any of the three sensors, an arming signal is provided to arm the unit 17, as already explained. Relay winding 40 is energized and pulls contact 36 to engage fixed contact 41. Thereafter a signal from any one of the sensors 13, 14 and 42 will be effective, over contacts 36 and 41, to provide an alarm indication to the alarm system 17. Again it is noted that the same sensors which are used to control the arming sequence are later used—after the alarm unit is armed—to provide alarm indications to the alarm unit.

In the following claims, the term "connected" means there is a solid electrical connection between two or more components, with virtually zero resistance between those components. The term "coupled" means there is at least a signal path between the components designated, and this path may include air, impedance, resistance or other transfer media.

While only certain embodiments of the invention have been described and illustrated, it will be understood that various modifications and alterations made be made therein. It is the intention, therefore, in the appended claims to cover all such modifications and alterations as may fall within the true spirit and scope of the invention.

What is claimed:

1. An alarm system comprising: sensor means for providing an output signal upon sensing a given condition; an alarm unit for providing an alarm signal upon receipt of the output signal from the sensor means when the alarm unit is armed; and timer means, coupled between the sensor means and the alarm unit when the alarm unit is not armed, which timer means is reset to a preset count each time it receives an indication that the sensor means has detected said given condition, and which timer means is allowed to count down from the preset count while no sensor means are providing output signals; and an arming signal, generated by the timer completing its countdown, which arms the alarm unit.

2. A system as claimed in claim 1, and further comprising a second sensor means coupled to the timer means, which second sensor means provides an output signal upon sensing a second condition which differs from said given condition, and means, coupled between the second sensor means and the alarm unit, for passing the second sensor output signal to the alarm unit so that, if the alarm unit is already armed, an alarm signal will be issued.

3. A system as claimed in claim 1, in which said sensor means is a motion detector.

4. A system as claimed in claim 1, in which said timer means is operative to issue a warning signal at a predetermined interval before the issuance of said arming signal, and warning means connected for activation by said warning signal.

5. A system as claimed in claim 4, in which said warning means is a high intensity, flashing light.

6. A system as claimed in claim 1, and further comprising a second sensor means coupled to the timer means, for providing an output signal to the timer means upon sensing said given condition.

7. The method of automatically insuring the arming of an alarm system, comprising the steps of:

providing an alarm unit for issuing an alarm signal upon receipt of a sensor output signal, while the alarm unit is armed, providing a sensor which produces an output signal when a given condition is sensed, providing a timer operative to count through a preselected time period and, upon expiration of the preselected time period, to provide an arming signal to the alarm unit to effect arming of the alarm unit, and utilizing the output signal from the sensor to reset the timer to the beginning of the preselected timer period, while the alarm unit is not armed.

8. An alarm system comprising: a first sensor for providing a first output signal upon sensing a given condition, a second sensor for providing a second output signal upon sensing said given condition, an alarm unit for providing an alarm signal upon receipt of either of the first and second output signals from the sensors when the alarm unit is armed; and timer means, coupled between the alarm unit and the first and second sensors when the alarm, unit is not armed, which timer means is reset to a preset count each time it receives an indication that either sensor has detected said given condition, and which timer means is allowed to count down from the preset count while neither of the first and second sensors is providing an output signal, said timer means also being effective to issue a warning signal at a predetermined interval before the issuance of an alarm signal by the alarm unit, and an arming signal, generated by the timer completing its countdown, which arms the alarm unit.

9. An alarm system as claimed in claim 8, including means coupled between said alarm unit and the first and second sensors for passing the first and second output signals from the sensors to the alarm unit so that, if the alarm unit is already armed, an alarm signal will be issued.

10. An alarm system as claimed in claim 9, including a third sensor for providing a third output signal upon sensing a given condition, and means coupling the third sensor to the timer and to the alarm unit, to reset the timer when the third sensor senses the given condition and to enable the alarm unit to issue an alarm signal if the alarm unit is already armed.

* * * * *